US005082100A

United States Patent [19]

Guyonneau

[11] Patent Number: 5,082,100

[45] Date of Patent: Jan. 21, 1992

[54] DEVICE FOR PROCESSING COINS

[75] Inventor: Patrick Guyonneau, Viroflay, France

[73] Assignee: Electronique Serge Dassault, Saint-Cloud, France

[21] Appl. No.: 378,255

[22] Filed: Jul. 11, 1989

[30] Foreign Application Priority Data

Jul. 15, 1988 [FR] France ..... 88 09639

[51] Int. Cl.[5] ..... G07F 1/00

[52] U.S. Cl. ..... 194/343; 453/56; 198/626.1

[58] Field of Search ..... 194/342, 343, 346; 453/56; 198/626, 604, 690.2, 699, 699.1

[56] References Cited

U.S. PATENT DOCUMENTS 3,175,563 3/1965 Simmerman et al. ..... 453/56
3,442,272 5/1969 Buchholz et al. ..... 453/56
3,841,457 10/1974 Kawasaki et al. ..... 194/355
3,853,016 12/1974 Lane et al. ..... 198/626 X
3,904,021 9/1975 Schweitzer ..... 453/56 X
4,214,654 7/1980 Pryor et al. ..... 194/343
4,457,320 7/1984 Diamond ..... 194/343 X

FOREIGN PATENT DOCUMENTS 2263973 10/1974 Fed. Rep. of Germany .
2843859 4/1979 Fed. Rep. of Germany ..... 453/56

*Primary Examiner*—F. J. Bartuska
*Attorney, Agent, or Firm*—Christie, Parker & Hale

[57] ABSTRACT

The device comprises a housing possessing a front face provided with an admission slot for coins and with a coin return receptacle. A conveyor, situated in a shaft communicating by gravity with the return receptacle, transports the coins from the admission slot to a processing module. The conveyor possesses two notched belts interacting with each other to ensure the transportation of the coins with one belt extending below the interacting surfaces of the two belts.

15 Claims, 7 Drawing Sheets

DEVICE FOR PROCESSING COINS

BACKGROUND OF THE INVENTION

The invention relates to the processing of coins.

It relates in particular to automatic dispensers of tickets, for example transport tickets, although the invention is not limited to this application.

It is appropriate to note here that the term "coins" applies to any discoid object capable of having a pecuniary value. This, of couse, applies to genuine coins, but can also be applied for example to tokens or the like.

The function of such a dispenser is to issue a ticket on receipt of a sum of money greater than or equal to the value of the ticket. In the event that the difference between this sum and the value of the ticket is not zero, coins corresponding to the total of the said difference are returned.

A dispenser of this type possesses a front face provided with an admission slot for the coins and with a receptacle for returning coins and/or the ticket. In its interior, it comprises a processing module connected to the admission slot and suitable for receiving, by gravity, the coins introduced therein, identifying them, and if appropriate issuing coins into the return receptacle if the exact payment has not been made.

Among known processing modules, two types may be distinguished. Those of a first type possess a coin identification assembly which determines the characteristics of the coins by means of sensors in front of which the coins pass during their fall, under the action of gravity, from their entry into the module. The presence of these various sensors consequently requires a minimum height of the identification assembly. Downstream of the said assembly is a coin storage assembly, of which the lower part forms the outlet from the processing module. Such a module is, for example, marketed by the American Company Mars Electronics under the reference MS514S.

The modules of the first type thus possess a relatively substantial height (typically of the order of 700 mm for the MS514S module).

The processing modules of the second type identify the coins by means other than falling under the action of gravity. In practice, each coin is transported by a carriage, then immobilized, and its characteristics are then identified in that position. These modules therefore generally possess a reduced bulk but are, on the other hand, much more complex and more fragile.

The bulk of these various processing modules largely determines that of the dispenser. Now, in order to extend the range of persons capable of using the automatic dispensers, the height of the coin admission slot relative to the ground must not exceed a certain figure, typically of the order of 1.30 m. Similarly, the minimum height of the return receptacle relative to the ground is typically of the order of 700 mm.

At present, therefore, compliance with these constraints makes it impossible to use a processing module of the first type, since the admission slot must necessarily be situated above the inlet to the module, while the return receptacle must be situated below its outlet.

SUMMARY OF THE INVENTION

The principal object of the invention is therefore to solve this problem.

An object of the invention is to permit the use of such dispensers, in particular comprising a processing module of the first type, while complying with the constraints on the heights of the admission slot and of the return receptacle.

A further object of the invention is to regulate the admission flow of the coins into the processing module, whatever may be the rate at which the coins are introduced into the slot by the user.

A further object of the invention is to permit the coins to be admitted one by one into the processing module, even if a plurality of coins are simultaneously introudced into the admission slot.

A further object of the invention is to discharge to the return receptacle any article other than a coin which is introduced into the slot and may inhibit the proper operation thereof.

The invention therefore relates to a device for processing coins or the like, comprising a housing prossessing a front face provided with an admission slot for coins and a coin return receptacle, the said housing possessing, in its interior, a module for processing the coins, means of routing the coins from the admission slot to the entry of the processing module and coin return means connecting the outlet from the processing module to the return receptacle, wherein the routing means comprise, in a shaft communicating by gravity with the return receptacle:

a conveyor equipped with at least a first belt which is notched on at least one of its faces, the said first belt possessing a lower part forming a lower end of the conveyor, a gravity coin admission passage, possessing an admission inlet opposite the admission slot and terminating in a flank neighboring the notched face of the lower part of the first belt, distancing means for periodically distancing the lower part of the first belt from the said flank and, transfer means, situated at the top of the conveyor and suitable for transferring the coins from the conveyor to the inlet to the processing module.

The distancing means are advantageously suitable for alternately displacing the lower part of the belt between a first position, in which the notched face is flush with the flank, and a second position, distanced relative to the first postion, the travel of this distancing being at least substantially equal to the maximum thickness of the coins.

In a preferred embodiment the first belt is driven by motor means and the distancing means comprise an eccentric roller situated opposite the said flank and driven by the first belt.

The conveyor advantageously comprises a second belt, notched on at least one of its faces, the notches of which enage with those of the first belt.

BRIEF DESCRIPTION OF THE DRAWINGS

Other advantages and features of the invention will become apparent on examination of the detailed description which follows and the attached drawings, in which.

DETAILED DESCRIPTION OF THE DRAWINGS

The drawings include, in essence, elements of specific character and form an integral part of the description. To this end, they may not only be used for a better comprehension of the detailed description which follows, but may also, if appropriate, help to define the invention.

Figure 1:
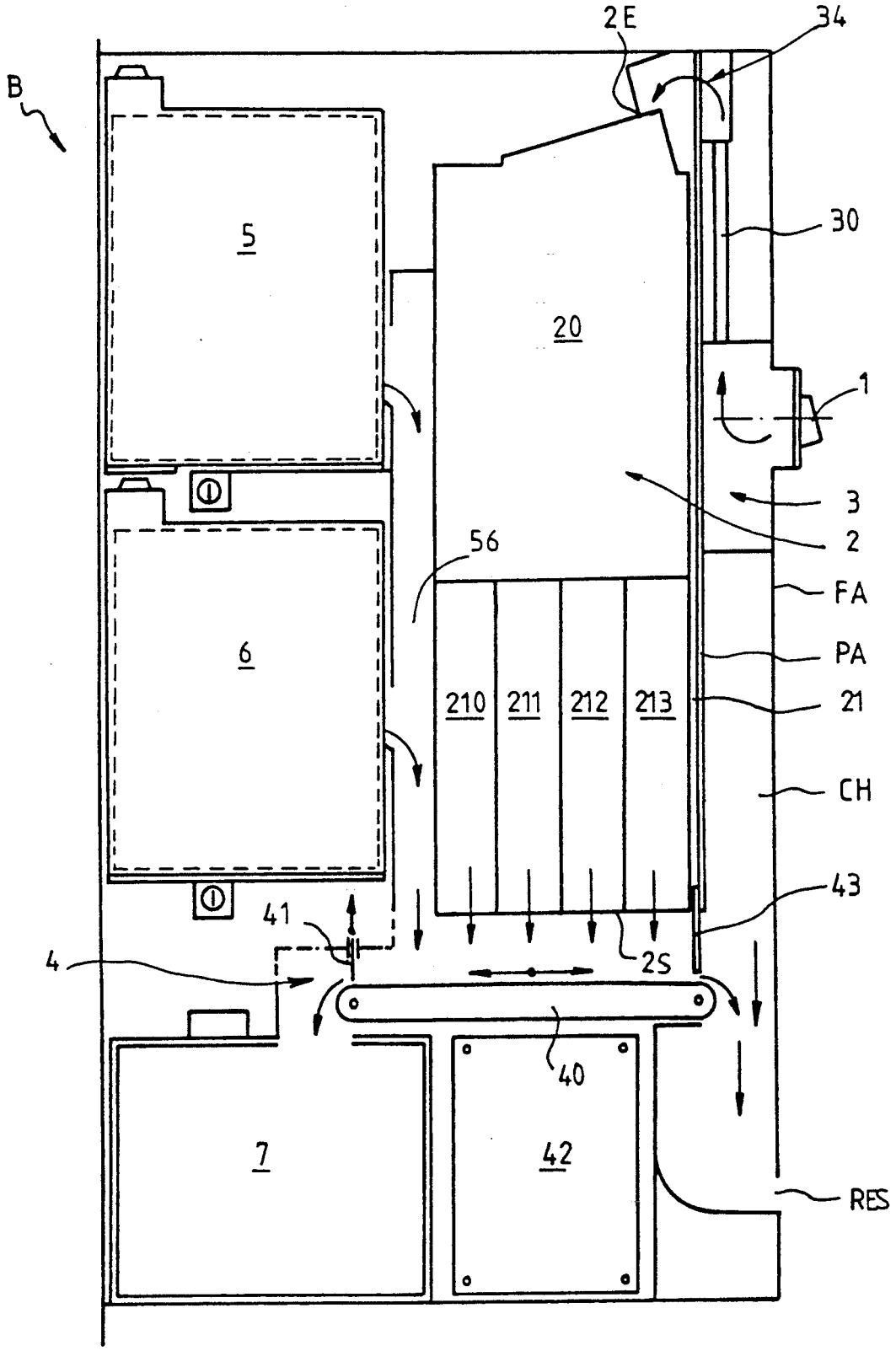
FIG. 1 is a diagrammatic representation of an embodiment of the device according to the invention.

The processing device, as shown in FIG. 1, comprises a housing B possessing a front face FA provided with a coin admission slot 1, and with a coin return receptacle RES. Within the housing B, a wall PA is situated opposite and at a distance from the front face FA, and defines therewith a shaft CH communicating by gravity with the receptacle RES.

The width of the admission slot is slightly greater than the maximum thickness of the coins introduced; here, this width is typically 4 mm.

On the other side of the wall PA is arranged a coin processing module 2. This module may be, for example, that marketed by the American Company Mars Corporation under reference MS514S. Such a module is capable of accepting six types of coin and recycling four types, and is essentially composed, in its upper part, of an identification assembly 20 for the coins introduced at its inlet 2E, extended in its lower part by an assembly for storing and recycling these coins 21.

This assembly 21 essentially comprises four tubes for storing and recycling the coins, 210 to 213, together with a channel for coins which have been accepted but not recycled, these communicating at their base with the outlet 2S from the processing module. Rejected coins, comprising invalid coins, are discharged directly into the shaft CH via a duct not shown in this Figure.

Coin return means 4 are situated between the outlet 2S from the processing module and the return receptacle RES. They comprise a conveyor belt 40, arranged opposite to and at a distance from the outlets of the four recycling tubes of the processing module and capable of being set in motion by control means 42, in a horizontal direction which is substantially perpendicular to the longitudinal direction of the tubes. This conveyor belt 40 terminates at one end in the shaft CH and at the other end in a collection receptacle 7, or cash box. A plate 41 is arranged in the vicinity of the end terminating in the cash box 7, and can be displaced in a translatory movement in a direction perpendicualr to the direction of movement of the conveyor belt 40. This plate 41 can then adopt a first position in which it is flush with the conveyor belt 40, and a second position in which it is situated at a selected distance from this conveyor belt. The choice of this distance will be explained hereinafter.

A skirt 43, adjoining the conveyor belt 40, is arranged in the vicinity of the end of the conveyor belt which terminates in the shaft, extending the wall PA of the housing.

The device likewise comprises two hoppers 5 and 6 containing a reserve of coins and intended, if appropriate, to return the correct change from the various tubes of the processing module. These two hoppers 5 and 6 communicate, under the effect of gravity, with the conveyor belt 40 via a channel 56. The hoppers used may be those marketed by the English Company Coin Controls Limited under the reference MKII.

Routing means 3 between the admission slot 1 and the inlet 2E of the processing module 2 are arranged in the shaft CH. These routing means comprise a conveyor 30 and transfer means 34 suitable for transferring the coins emerging from the conveyor to the inlet 2E of the processing module.

Figure 2:
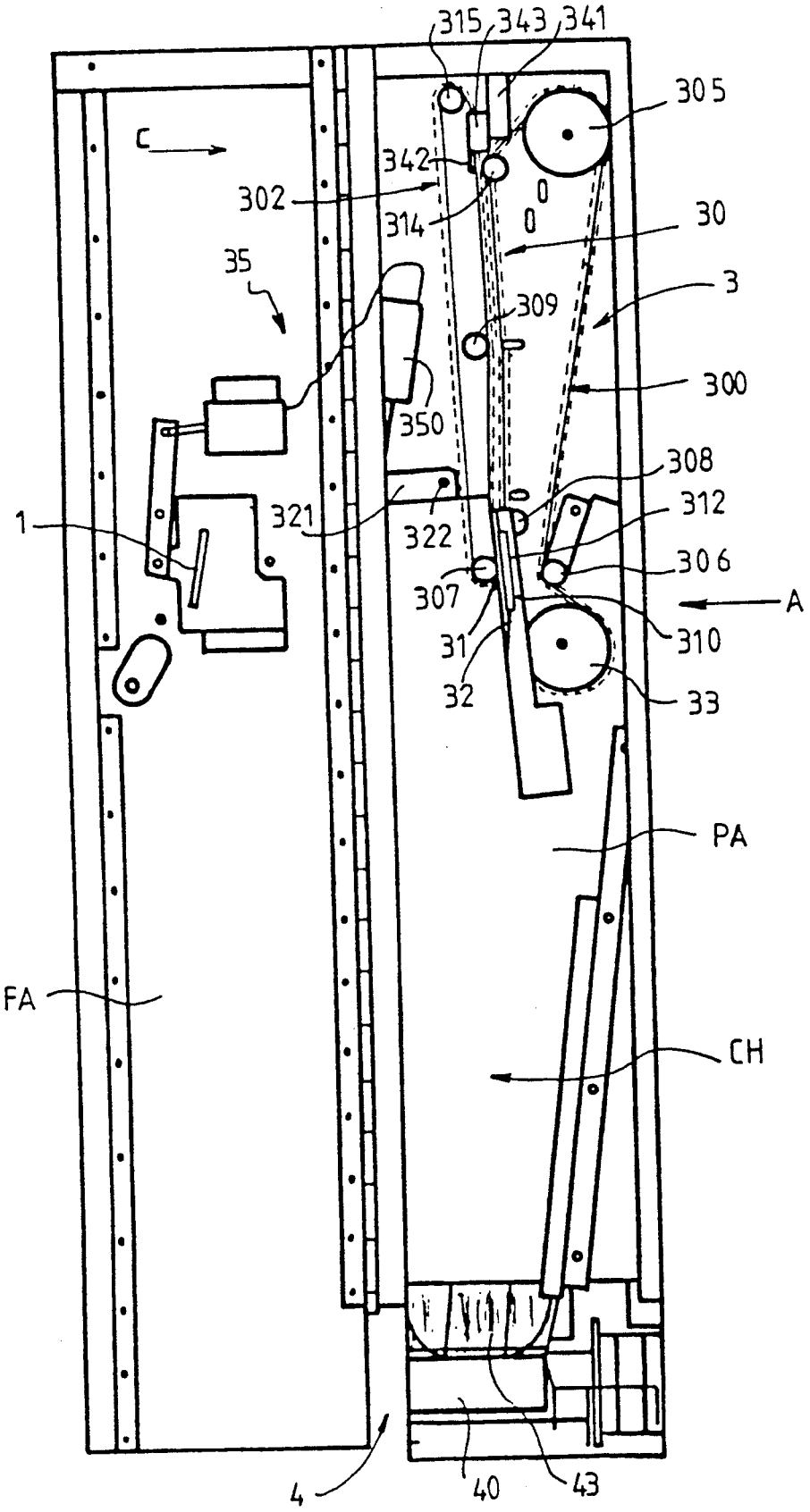
FIG. 2 is an elevation showing a part of the device according to FIG. 1, in particular the inlet means.
Figure 3:
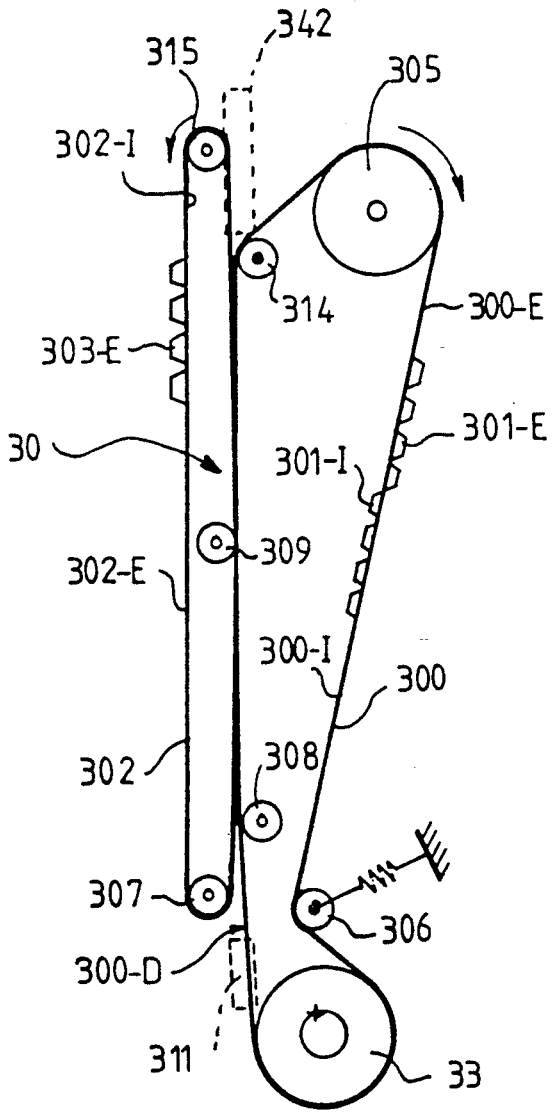
FIG. 3 is a diagrammatic representation of the paths of the various belts of the device.

FIG. 2 shows in a more detailed manner the routing means 3 situated in the shaft CH of the housing. A plurality of rollers 305, 306, 33, 308 309, 314 are fixed to the wall PA of this shaft, and around said rollers there circulates a first flat belt 300, notched on both faces. This first belt 300 partly enagages with a second belt 302 which is notched on its outer face and circulates around the roller 309 and the rollers 307 and 315. The interaction between the notches of these two belts defines a conveyor 30, a more detailed representation of which is illustrated in FIG. 3.

The roller 305 is a motor roller driving the notches 301-I of the second face or inner face, 300-I of the first belt 300. The first face, or outer face, 300-E of the first belt 300 engages, via the notches 301-E, with the notches 303-E of the outer face 302-E of the second belt 302, approximately between the rollers 308 and 314. The inner face 302-I of the second belt 302 is not notched and circulates around the rollers 307, 309 and 315, being driven by the first belt 300. It is appropriate to note here that the roller 309, arranged within the path of the second belt, could be situated on the other side of the conveyor.

Figure 3A:
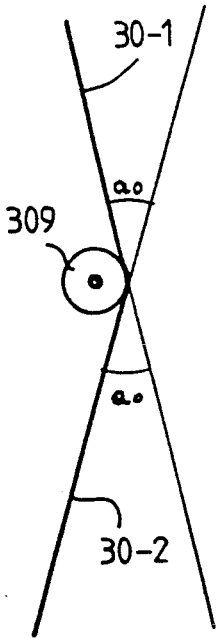
FIG. 3A is a detailed diagrammatic view of a portion of FIG. 3 illustrating the angles of the paths of the belts.

As shown in FIG. 3A, the path of this conveyor 30 thus essentially comprises two straight lines 30-1 and 30-2 forming, at the level of the roller 309, an angle aO substantially equal to 3°.

The first belt 300 possesses a lower part 300-D which overlaps below adjacent surfaces of belts 300 and 302 to form a lower end of the conveyor 30 and circulates around an eccentric roller 33. In order to compensate the variable path of the first belt, caused by the eccentric roller, the roller 306 is a stretcher roller interacting with the outer face 300-E of this first belt.

At the top of the conveyor is shown the outline of the inlet 342 of a duct giving access to the processing module 2 which will be described in detail below.

Figure 4:
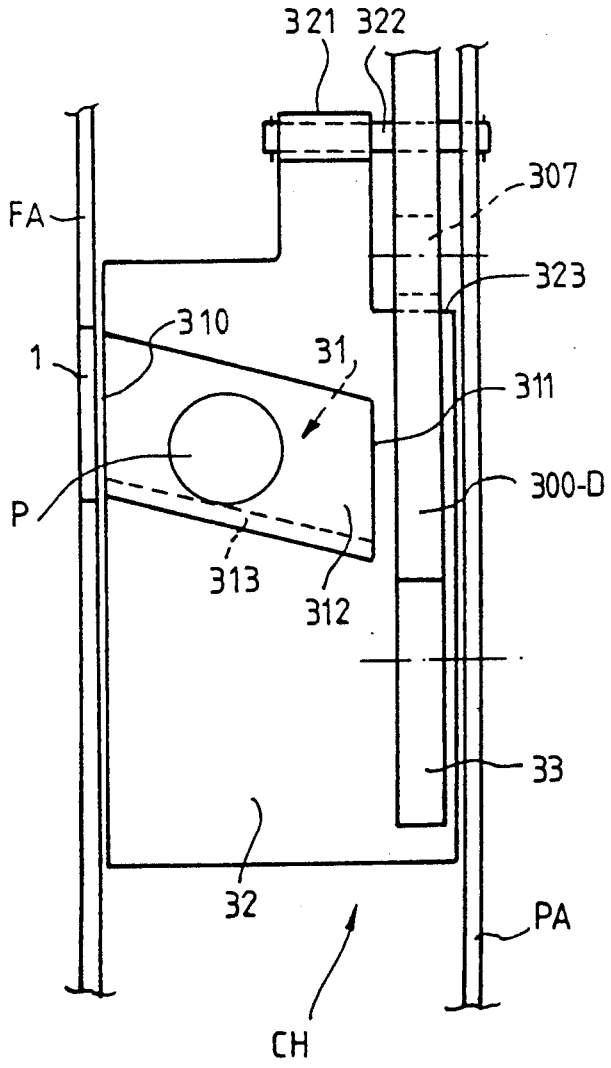
FIG. 4 is a partial diagrammatic view in the direction A of FIG. 2.
Figure 4A:
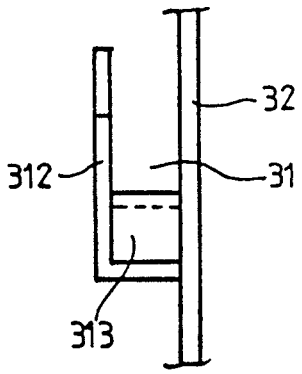
FIG. 4A is an enlarged sectional view of a portion of FIG. 4.

At the lower or level of the overlapping part 300-D of the first belt, between the roller 307 and the eccentric roller 33, the outline of the outlet end 311 for an admission passage for the coins P is illustrated in broken lines, and will now be described with reference more specifically to FIGS. 4 and 4A.

This coin admission passage 31 possesses an admission inlet 310 situated opposite the slot 1. It is delimited at the bottom by a slopping base 313 connecting the admission inlet 310 to the outlet end 311. The passage 31 is defined laterally on the one hand by an edge 312 and on the other hand by a flank 32 extending substantially perpendicularly in the shaft CH, between the front face FA and wall PA. The width of this passage is the same as that of the admission slot.

The flank 32 adjoins the overlapping part 300-D of the first belt 300, which latter is arranged between the wall PA and the outlet end 311 of the admission passage. An offset 323 is made in the flank 32, in the vicinity of the roller 307, in order to permit the passage of the first belt, which is not shown in this Figure.

The flank 32 is mounted on an element 321, capable of a pivoting motion, with elastic restoring means (not shown in this Figure) towards the overlapping part 300-D of the belt 300, about a shaft 322 fixed perpendicularly to the wall PA of the housing.

Figure 5:
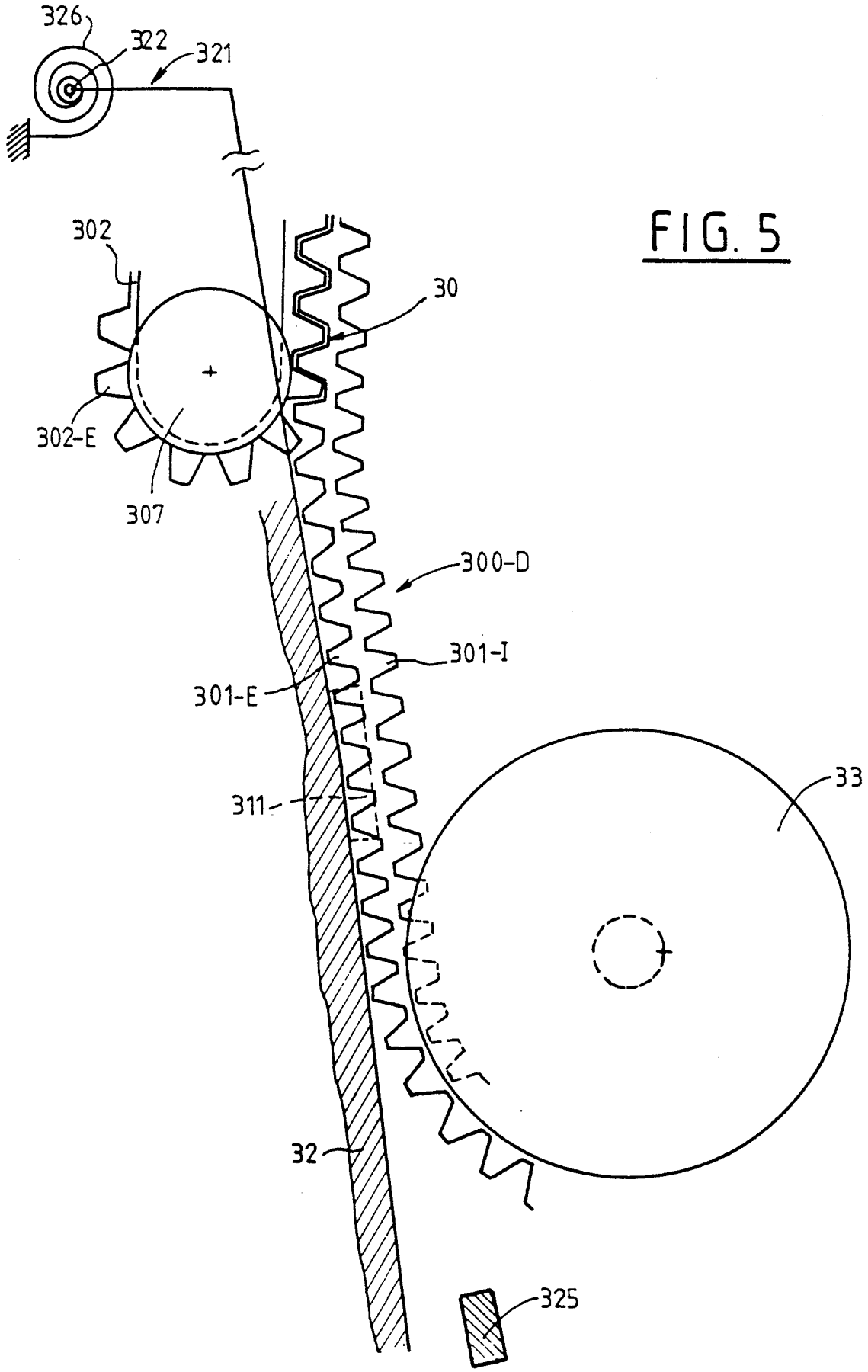
FIGS. 5 and 6 illustrate two positions for the lower part of the first belt of the conveyor.
Figure 6:
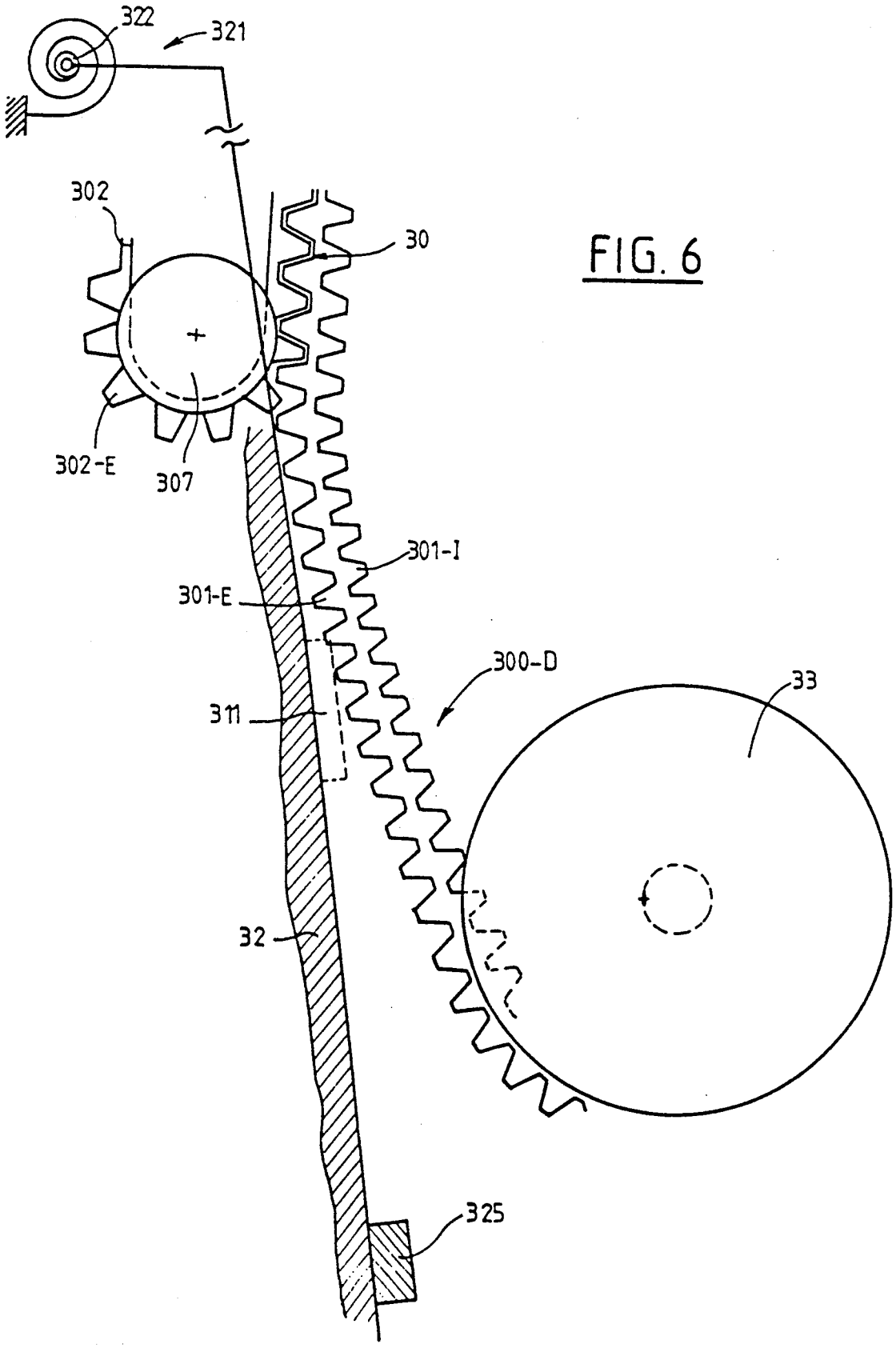

Since the overlapping part 300-D of the first belt is mounted on the eccentric roller 33 situated opposite the flank 32, it is capable of moving between a first position, illustrated in FIG. 5, and a second position, illustrated in FIG. 6. In these two Figures, the dimensions of some elements have been deliberately exaggerated, as have the mutual ratios of these dimensions.

The flank 32 is shown very diagrammatically as being mounted to pivot, with elastic restoring means 326, about the axis 322. The first position of the overlapping part 300-D is obtained when the long diameter of the eccentric roller 33 faces the flank 32. In this case, the notched outer face 301-E of this first belt is flush with the flank 32, in a manner such as to mask the outlet end 311 of the admission passage. It is appropriate to note here that the flush fitting with the belt is obtained partly by the position of the eccentric roller and partly by the elastic restoring of the flank 32.

In its second position, obtained when the short diameter of the eccentric roller 33 faces the flank 32, the notched outer face of the belt 300 is at a distance from the flank 32, and the outlet end 311 is broadly exposed. The angular clearance of the flank 32 is limited by a stop 325. The latter is shown diagrammatically in FIGS. 5 and 6 and in no way prejudices the production of this stop.

The two positions of the overlapping part 300-D are obtained by selecting the position of the eccentric roller relative to the flank, but also by selecting the thickness of the first belt. The range of the distancing of the overlapping part is selected to be at least substantially equal to the maximum thickness of the coins introduced, preferably slightly greater. Similarly, the thickness of the first belt naturally depends on the position of the fixing point of the eccentric roller, and is generally selected to be at least substantially equal to the maximum thickness of the coins, preferably equal. The thickness chosen here, by way of example, is about 4 mm. The choice of this thickness further makes it possible, when the belt is in its first position, to prevent a coin of reduced thickness working its way in on the wrong side of this belt, that is to say between the belt and the eccentric roller.

The routing means 3 also comprise a security member 35 (FIG. 2) having an electromagnet 350 which comes into contact with the end of the moving element 321 opposite to the flank 32 relative to the axis 322. This electromagnet 350 is controlled by software and is capable of moving the flank 32 away from the overlapping part 300-D of the belt, in a direction which tends to distance this part from the notched first face 300-E and hence from the eccentric roller 33.

Figure 7:
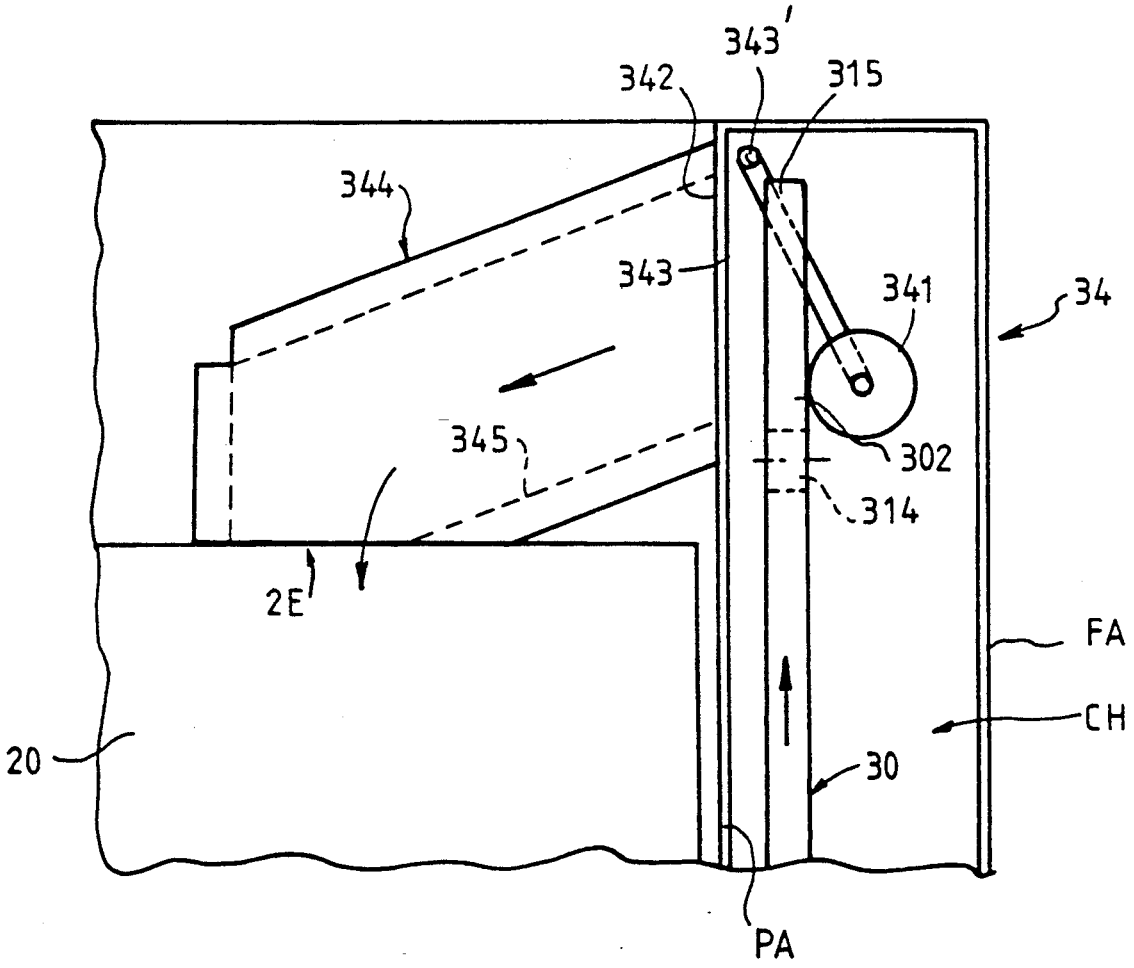
FIG. 7 is a partial diagrammatic view in the direction C according to FIG. 2.

Reference is now made to FIG. 7, to describe the transfer means 34 in greater detail. At the level of the roller 314, the first and second belts separate substantially opposite the inlet 342 to the access passage 344. The latter possesses a base 345, at a slight slope, in order to admit coins by gravity to the inlet 2E of the processing module 2. A milled wheel 341 is like-wise provided, fixed to the wall PA of the housing means of an inclined arm 343 which, under the effect of gravity, can execute a rotating movement about an axis 343' parallel to the wall PA. This milled wheel comes into contact by gravity with the flank of the belt 302 just above the roller 314, and thus makes it possible to introduce a coin of any diameter into the access passage 344.

A detailed description will now be given of the mode of operation of the device.

The motor roller 305 drives the first belt 300 along its path. The latter drives, in rotation, the eccentric roller 33, the effect of which is alternately to displace the overlapping part 300-D of this first belt between its first position, in which it is flush with the flank 32, and its second position which is at a distance relative to the first. The conveyor is thus set in motion by the interaction of the notches of the two belts 300 and 302. It is appropriate to note here that, despite the eccentric roller 33, the two belts engage with no problems. The speed of the "driving" belt 300 is constant on its ascending travel, at the level of the conveyor, but is not constant on its descending travel, and the stretcher roller 306 then takes up the slack in this belt. Since certain coins may be very thick, it is important that the belts should be very loosely stretched in a manner such as not to have excessive pressures at the level of the rollers.

When a coin P is introduced into the admission slot 1, it rolls under the effect of gravity on the base 313 of the passage 31 and finishes at the flank 32, opposite the overlapping part 300-D of the driving belt. This, clearly, is possible only when the outlet end 311 is exposed. The coin P is then, on the one hand, locked against the wall PA of the housing and caught by the notches of the outer face 301E of the belt 300, when the latter, under the influence of the movement of the eccentric roller, returns into its first position.

It will be noted, therefore, that the end 311 of the admission passage is alternately exposed and masked, thus regulating the admission flow of the coins whatever may be speed of introduction of the coins into the admission slot by the user.

The coin P leaves the flank 32 at the level of the offset 323 and is caught between the two belts 300 and 302, in a manner such as to be brought to the level of the roller 314 by the conveyor 30. The gripping and transportation of the coin between the two belts are advantageously facilitated by the narrow angle aO between the two straight lines of the path of the conveyor. Once the coin has arrived at the top of the latter, the ending of the interaction between the notches releases the coin. In the even that the coin is of small diameter, it is entrained by the conveyor, by being thrust against the wall PA. At the top of the conveyor, it thus falls naturally, under the effect of gravity, into the access passage 34. If, on the other hand, the coin is of larger diameter, its fall into the passage 344 is assisted by an impetus provided by the milled wheel 341.

The routing means make it possible to transport the coins over a height of about 30 cm, which enables the abovementioned constraints on the setting-up to be observed.

The thickness of the admission passage 31 may make it possible to introduce two thin coins, for example two 20 ct pieces, placed flush against one another. It is then essential to separate these two coins. The device achieves such a separation, since when the two coins emerge from the admission passage, one is in direct contact with the flank, which is fixed, while the other is in direct contact with the notched belt, which is mobile, and sliding of one coin relative to the other takes place, which tends to detach them.

In the event that a user introduces a foreign object into the admission slot, for example a ticket folded in four, the safety member 35 enables it to be evacuated into the shaft CH, towards the return receptacle RES. In effect, the electromagnet 350 acts on the mobile element, causing the flank 32 to pivot against the eccentric to drop the article into the shaft.

A description will now be give of the mode of operation in relation to the coin return means 4. The structure of the processing module used leads to emergence of coins at the base thereof within a very brief period after the introduction of the coins at the inlet. Now, there can be no question of automatically storing these coins in the cash box 7, since, while the customer has not received his ticket, he must be able to cancel the transaction and recover his coins. It is therefore necessary to provide a system which, during the period of the transaction, sets aside the coins that have come down from the processing module before sending them to the cash box 7 or, alternatively, towards the return receptacle. A system of various ducts and shutters would make it possible to achieve this function, but would require an additional, drop height relative to that already necessary for the processing module. There can be no question of this, bearing in mind the abovementioned constraints on the height of the slot and of the return receptacle.

Use of the conveyor belt 40 makes it possible to solve this problem while retaining a minimal bulk for the device. When the coins fall to the bottom of the processing module, the control means 42 set the conveyor belt 40 in motion at low speed towards the plate 41, and hence towards the cash box 7. The effect of this is to prevent the piling-up of coins falling on the conveyor belt. The plate 41, being in its flush position, acts as a retaining member and the coins come to accumulate against the latter. When the transaction is completed, the control means lift the plate 41 over a distance greater than the height of the pile formed and actuate the conveyor belt 40, and the coins fall into the cash box 7. In the subsequent half-second, the change liable to be repaid to the customer in the event of overpayment falls onto the conveyor belt, and the latter is set in motion by the control means toward the shaft CH. The function here of the skirt 43 is to prevent a premature dropping of coins into the shaft when the latter fall from the processing module onto the conveyor belt.

If the transaction is not completed, the conveyor belt 40 is set in motion towards the shaft CH, returning the coins introduced.

The invention is not limited to the module described above but embraces all variations thereof, in particular the following:

the use of an eccentric roller is particularly advantageous to produce the alternating movement of the belt relative to the flank when the same energy source is used to create this movement and to drive the driving belt 300. However, any other type of distancing means could be considered;

the routing means are particularly advantageous in the case where a processing module of the first type is used. However, such routing means could be used with any other type of processing module, whatever its height. It has, in fact, particularly been noted that the arrangement of the overlapping part of the belt and of the flank makes it possible to detach two coins introduced simultaneously into an admission slot, which had hitherto been of concern to those skilled in the art.

Of course, some of the means described above can be omitted in variations where they are not of use.

I claim:

1. A device for processing coins, comprising a housing having a front face provided with an admission slot for coins and a coin return receptacle, the housing having in its interior, a module for processing the coins, means for routing the coins from the admission slot to the entry of the processing module and coin return means connecting the outlet from the processing module to the return receptacle, wherein the routing means comprise in a shaft communicating by gravity with the return receptacle:

a conveyor equipped with at least a first belt having notches on at least a first face thereof, the conveyor having a lower end, and the first belt having a lower part which forms the lower end of the conveyor, a gravity coin admission passage having an admission inlet opposite the admission slot and terminating in a flank adjacent the notched face of the lower part of the first belt, distancing means for periodically distancing the lower part of the first belt from the flank and, transfer means situated at the top of the conveyor and adapted for transferring the coins from the conveyor to the inlet to the processing module.

2. The device as claimed in claim 1, wherein the admission slot is situated below the entry to the processing module.

3. The device as claimed in claim 1, wherein the distancing means are capable of alternately displacing the lower part of the first belt between a first position, in which the notched face is flush with the flank, and a second position, distanced relative to the first, the travel of this distancing being at least substantially equal to the maximum thickness of the coins.

4. The device as claimed in claim 3, wherein the thickness of the first belt is at least substantially equal to the maximum thickness of the coins.

5. The device as claimed in claim 1, wherein the first belt is driven by motor means and wherein the distancing means comprise an eccentric roller situated opposite the flank and driven in rotation by the lower part of the first belt.

6. The device as claimed in claim 1, wherein the first belt is notched on both faces.

7. The device as claimed in claim 5, wherein the first belt is notched on both faces, the motor means interacting with the second face of the first belt.

8. The device as claimed in claim 1, wherein the flank is pivotally mounted and is biased towards the lower part of the first belt, and wherein the routing means comprise a stop limiting the angular travel of the flank when the distancing of the lower part of the first belt is at its maximum.

9. The device as claimed in claim 1, wherein the routing means comprise a safety member far distancing the flank from the lower part of the first belt in a direction opposite to the maxium direction of distancing of the overlapping part.

10. The device as claimed in claim 1, wherein the conveyor comprises a second belt having notches on at least one of its faces, the notches of this second belt interacting with the notches of the first face of the first belt above the lower part of the first belt.

11. The device as claimed in claim 10, wherein the path of the conveyor comprises a first straight line extended by a second straight line forming a selected angle with the first straight line.

12. The device as claimed in claim 1, wherein the transfer means comprise a gravity access duct towards the inlet of the processing module, arranged on one side of the conveyor, and a milled wheel arranged on the other side of the conveyor and capable of pushing the coins into the access duct.

13. The device as claimed in claim 1, wherein the return means comprise a conveyor belt situated opposite the outlet from the processing module and terminating at one end in the shaft and at the other end in a coin collection receptacle, and control means for moving the conveyor belt either in the direction of the shaft or in the direction of the collection receptacle.

14. The device as claimed in claim 13, wherein the return means comprise a coin retention member which is displaceable relative to said conveyor belt between a first position, in which it is substantially flush with the conveyor belt, and a second position, in which it is spaced from the conveyor belt.

15. A device for processing coins, comprising a housing having a front face provided with an admission slot for coins and a coin return receptacle, the housing having in its interior a module for processing the coins, means for routing the coins from the admission slot to the entry of the processing module, and coin return means connecting the outlet from the processing module to the return receptacle, wherein the routing means is disposed in a shaft communicating by gravity with the return receptacle, the routing means comprising:

means for conveying coins comprising at least one movable belt having notches on at least one face thereof, and means for moving the belt, the conveying means having a lower end, a gravity coin admission passage having an admission inlet opposite the admission slot and an outlet terminating in a flank, wherein the belt has a lower portion with its notched face at the lower end of the conveying means for contacting the flank such that the lower portion of the belt blocks the outlet of the admission passage, means for periodically distancing the lower portion of the belt from the flank to unblock the admission passage outlet and moving the lower portion of the belt back to the flank so that at least one coin can fit between the belt and flank with its primary faces contacted by the belt and flank, and transfer means situated at the top of the conveying means and adapted for transferring the coins from the conveying means to the inelet of the processing module.

* * * * *